US008246332B2

(12) United States Patent
Cadeddu et al.

(10) Patent No.: US 8,246,332 B2
(45) Date of Patent: Aug. 21, 2012

(54) ROTOR FOR A VANE PUMP, MADE OF PLASTIC MATERIAL REINFORCED BY METALLIC FOIL

(75) Inventors: Leonardo Cadeddu, Crema (IT); Franco Fermini, Cremona (IT); Vittorio Polloni, Crema (IT)

(73) Assignee: VHIT S.p.A., Offanengo (IT)

( * ) Notice: Subject to any disclaimer, the term of this patent is extended or adjusted under 35 U.S.C. 154(b) by 562 days.

(21) Appl. No.: 12/294,046

(22) PCT Filed: Apr. 3, 2007

(86) PCT No.: PCT/EP2007/003078

§ 371 (c)(1),
(2), (4) Date: Sep. 23, 2008

(87) PCT Pub. No.: WO2007/115782

PCT Pub. Date: Oct. 18, 2007

(65) Prior Publication Data

US 2009/0104063 A1 Apr. 23, 2009

(30) Foreign Application Priority Data

Apr. 11, 2006 (IT) ..... TO06A0263

(51) Int. Cl.
*F01C 21/08* (2006.01)
*F04C 29/00* (2006.01)

(52) U.S. Cl. ..... 418/152; 418/178; 418/179

(58) Field of Classification Search ..... 418/152, 418/179, 178, 253–258
See application file for complete search history.

(56) References Cited

U.S. PATENT DOCUMENTS

| | | | | |
|---|---|---|---|---|
| 2,903,971 | A | 9/1959 | Collins | |
| 3,734,654 | A * | 5/1973 | Burenga et al. | 418/152 |
| 4,253,809 | A * | 3/1981 | Ishizuka et al. | 418/152 |
| 6,923,628 | B1 | 8/2005 | Otto | |
| 7,866,967 | B2 * | 1/2011 | Heidemeyer | 418/152 |
| 2008/0253915 | A1 * | 10/2008 | Moore | 418/142 |

FOREIGN PATENT DOCUMENTS

| | | |
|---|---|---|
| EP | 1 471 255 | 10/2004 |
| GB | 381 371 | 10/1932 |
| WO | WO 02/097274 | 12/2002 |
| WO | WO 2006/042493 | 4/2006 |

OTHER PUBLICATIONS

International Search Report dated Jul. 11, 2007, in PCT application.

* cited by examiner

*Primary Examiner* — Mary A Davis
(74) *Attorney, Agent, or Firm* — Young & Thompson

(57) ABSTRACT

A rotor (1-3) molded of plastic material, intended for rotary installation in a cavity of a pump body and for reception of one or more vanes forming the pumping members, characterized in that at least a part of the surfaces thereof, intended to undergo sliding displacements against other pump members, is covered by at least one metallic foil (4) caused to adhere to the subjacent surface of plastic material. The metallic foil can consist of a steel sheet or an aluminum alloy sheet, intended for reducing the resistances to the sliding as well as for mechanically reinforcing the rotor. The metallic foil can be fastened to the plastic material body (1) of the rotor by a co-molding operation, or it can be mechanically fixed to the body (1) of the rotor molded of plastic material.

8 Claims, 2 Drawing Sheets

ROTOR FOR A VANE PUMP, MADE OF PLASTIC MATERIAL REINFORCED BY METALLIC FOIL

BACKGROUND OF THE INVENTION

1. Field of the Invention

The subject of the present invention is a rotor moulded of plastic material, intended for rotary installation in a cavity of a pump body and for reception of one or more vanes forming the pumping members. The vane pumps are widely used for pumping fluids, and for example they find particular applications in motor vehicles.

2. Related Art

To the rotor of a vane pump three operations are mainly required:

(1) Transmission of the motion. The rotor, which is driven in rotation within a chamber of the pump body, transmits the movement to the vane or the vanes of the pump. It undergoes sliding displacements against the surfaces of the pump body with respect to which it is made to rotate. The rotor is required not to undergo excessive wear and not to produce excessive friction during its sliding displacements.

(2) Guide for the vane or the vanes of the pump. The rotor guides the vane or the vanes which, during the operation, undergo sliding displacements against the guide parts of the rotor. The rotor is required not to undergo itself nor cause to the vanes a noticeable wear, and not to produce excessive friction.

(3) Seal of the fluids. The rotor is required to actuate an operation of seal to the air and the oil in correspondence to the mechanical clearances and, in particular, to the friction bearings and to the regions where the rotor is tangent to the wall of the chamber inside the pump body.

In order to be able to perform these different functions, these rotors have a relatively complicated shape and, therefore, it is suitable and customary that they are embodied by moulding a suitable plastic material. However, the rotors of plastic material have some disadvantages. The plastic material has not a high mechanical resistance, it is relatively subject to wear in the portions subject to gliding contact, it is subject to non negligible ageing phenomena, and it is considerably sensible to the changes in temperature, which are particularly severe in the applications to motor vehicles, where the pump is required to operate within a large temperature field from −40° C. to +150° C.

According to the known technique, these disadvantages may be partially overcome or reduced by having recourse to special complicated rotor shapes and to an increase of the cross sections thereof and therefore of the quantity of material used, and in any event it is unavoidable to accept a suitable limitation of the stresses undergone by the material, to which correspond some limitations of the possible rotor performances.

SUMMARY OF THE INVENTION

This invention aims to improve the plastic material rotors for vane pumps, by avoiding or reducing the stated disadvantages, and thus allowing the rotors to give better performances without increasing their size and mass.

Therefore, the subject of this invention is a rotor, moulded of plastic material, intended to be rotatably mounted into a cavity of a pump body, and having a space intended to accommodate one or more vanes forming the pumping members, characterized in that at least a part of the surfaces thereof, intended to undergo sliding displacements against other pump members, is covered by at least one metallic foil caused to adhere to the subjacent surface of plastic material, intended to reduce the resistances to the sliding displacements and also to mechanically reinforce the rotor. Said metallic foil can preferably consist of a steel sheet or an aluminum alloy sheet.

The application of the feature according to the invention allows attaining various considerable advantages. In particular, the mechanical resistance of the rotor is increased without having recourse to increased cross sections and therefore to an increased mass of plastic material. It is therefore possible to provide rotors having performances like those of the usual rotors, by somewhat reducing the size, the weight and finally the cost thereof, or even to conserve the size of a rotor by increasing its performances without increasing its mass and cost. For example, it becomes possible to have the pump rotating at an increased speed and therefore giving higher performances. For example, on a diesel engine it becomes possible to have the pump driven by an output shaft more rapid than that usually employed. Such pumps may also find useful applications on gasoline engines, wherein the rotational speed is larger that that of diesel engines. In designing the pump it is possible to provide a larger axial extension of the vanes, thus attaining a larger volume with a same rotor diameter. Also, a better resistance to the temperature is attained, whereby work conditions are allowed, that are more burdensome than those usually allowable.

Preferably, the metallic foil has a main substantially plane working surface and some portions bent with respect to the working surface, serving for anchoring the metallic foil to the rotor of plastic material.

In some embodiments of the invention, the metallic foil is made solid to the rotor body of plastic material by co-moulding. In this case, the other portions of the metallic foil that are bent with respect to its main working surface may receive configurations particularly suitable for increasing the anchorage of the metallic foil to the rotor body at the time of the co-moulding operation.

In other embodiments, the metallic foil is mechanically fixed to the rotor body that is moulded of plastic material. In this case, the portions of the metallic foil that are bent with respect to its main working surface may receive configurations particularly suitable for increasing the mechanical anchorage of the metallic foil to the rotor body that is moulded of plastic material.

In special embodiments, the metallic foil has a substantially plane working surface, intended to cover an end surface of the rotor, from which project some portions bent with respect to said plane surface, intended to line the rotor space designed to receive one or more vanes. It is of advantage that said bent portions intended to line the rotor space designed for receiving the vanes are terminated, at their end portions opposite said plane surface, by conformations suitable for being mutually connected or stuck.

Alternatively, said bent portions intended to line the rotor space designed for receiving the vanes may be terminated, at their end portions opposite said plane surface, by tongues suitable for being bent against corresponding rotor surfaces.

BRIEF DESCRIPTION OF THE DRAWINGS

These and other features, objects and advantages of the subject of the present invention will more clearly appear from the following description of some embodiments, being not limiting examples, with reference to the accompanying drawings, wherein.

DETAILED DESCRIPTION

Figure 1:
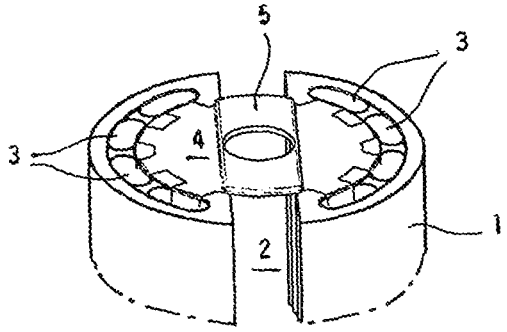
FIG. 1 illustrates in perspective view an end portion of a rotor that is provided, according to the invention, with a co-moulded metallic foil which covers only the pivoting surface of the rotor.
Figure 2:
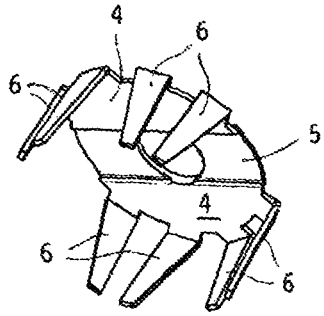
FIG. 2 illustrates in perspective view the metallic foil used according to FIG. 1.

Referring now to FIG. 1, number 1 designates a first end portion of a rotor for a vane pump, which is embodied of plastic material, and number 12 designates a second end portion coupled to the first end portions 1 of the rotor. This end portion is pivoted to the pump body and it is intended to rotate contacting a wall of the cavity of the pump body (not represented). Rotor 1 is provided with a space 2 intended to receive and guide one or two vanes (not represented). Moreover rotor 1 has several cavities 3 whose aim is to reduce the weight of the rotor body as well as the quantity of material needed for its manufacture. According to the invention, in order to reinforce this end portion of rotor 1, use is made of a metallic foil (made for example of steel sheet or of a suitable aluminum alloy sheet) which is shaped as shown by FIG. 2. The metallic foil has an annular plane surface 4 with a diametral portion 5 slightly projecting in correspondence with the space 2 for the vanes, and from this portion extend tongues 6 bent at right angle. The metallic-foil 4-6 is co-moulded with the rotor 1 of plastic material, by inserting the metallic foil into the mould wherein the rotor is formed. In the finished rotor, the surface 4-5 of the metallic foil covers the end face of rotor 1 and forms the surface that will rotate contacting the pump body, by absorbing the contact forces and avoiding the wear of rotor 1, and also acting in the sense of preventing dimensional changes of the rotor. The tongues 6, which are incorporated in the co-moulding of the plastic material forming the rotor 1, have the function of a root and they make the metallic foil definitively solid with the rotor. The embodiment described is suitable when only the end face of the rotor 1 has to be reinforced, and there is no need for reinforcing the space 2 for the vanes.

Figure 3:
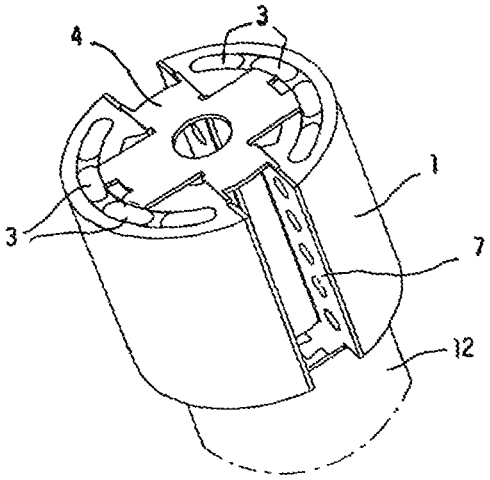
FIG. 3 illustrates in perspective view an end portion of a rotor that is provided, according to the invention, with a co-moulded metallic foil which covers the pivoting surface as well as the guide surfaces for the vanes.
Figure 4:
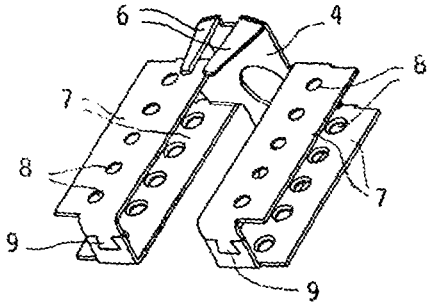
FIG. 4 illustrates in perspective view the metallic foil used according to FIG. 3, in its final shape.
Figure 5:
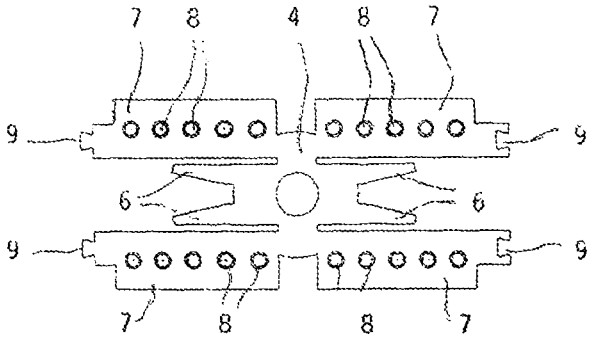
FIG. 5 illustrates in a plan view a semi-finished metallic foil from which, by bending operations, is obtained the metallic foil according to FIG. 4.

In those cases in which not only the end face of rotor 1 has to be reinforced, but also the space 2 for the vanes, in the manufacture of the rotor of FIG. 3 may be co-moulded a metallic foil as that represented in FIG. 4. This metallic foil yet comprises a plane surface 4 intended to form the front surface of the rotor, from which extend root tongues 6 bent at right angle. Moreover, from the surface 4 also extend strips 7 bent at a right angle, that are intended to form the inner surfaces of the space 2 for the vanes. These strips 7 will absorb the forces of the contact with the vanes and they will be able to prevent the wear of both parts. If the case may be, the strips 7 may be provided with holes 8 suitable for ensuring a more perfect adhesion of the strips 7 to the co-moulded plastic material. It is also of advantage that the strips 7 are terminated, at their end portions opposite the surface 4, by conformations 9 suitable for being mutually stuck, as represented by FIG. 4. The described metallic foil 477 is obtained, by several subsequent bending operations, from a plane semi-finished piece as that represented in FIG. 5, which has been sheared from a metallic plate.

In the embodiments so far described, the reinforcement metallic foil is joined to the rotor by a co-moulding operation. However it is also possible, and in certain cases may be preferable, that the metallic foil is connected to the rotor by mechanical way, without having recourse to a co-moulding operation. To this operating manner-refer the embodiments described in the following.

Figure 6:
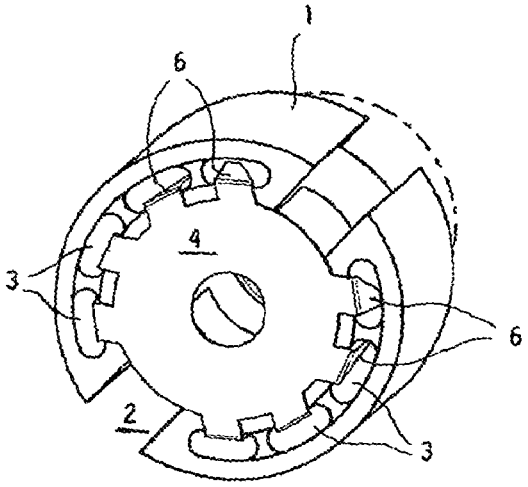
FIG. 6 illustrates in perspective view an end portion of a rotor that is provided, according to the invention, with a mechanically fixed metallic foil which covers only the pivoting surface.
Figure 7:
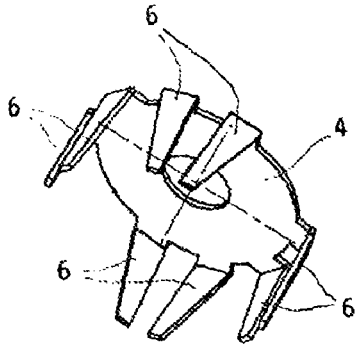
FIG. 7 illustrates in perspective view the metallic foil used according to FIG. 6.
Figure 8:
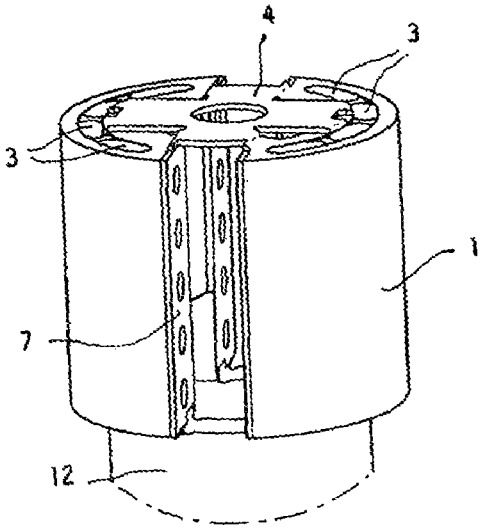
FIG. 8 illustrates in perspective view a portion of a rotor provided, according to the invention, with a mechanically fixed metallic foil that covers the pivoting surface as well as the guide surfaces for the vanes.

FIG. 6 refers, as the preceding FIG. 1, to the case in which only the end face of rotor 1 has to be reinforced, and there is no need for reinforcing the space 2 for the vanes. In this case, use is made of a metallic foil according to FIG. 7, which has an annular plane surface 4 from which extend tongues 6 bent at right angle. The metallic foil 4-6, in this case, is fixed to the rotor 1 moulded of plastic material, by inserting the tongues 6 into the cavity 3 of rotor 1. Suitable conformations and dimensions of the parts may ensure the solid connection of the metallic foil 4-6 to rotor 1, of which the metallic foil then forms the end face intended to rotate contacting the pump body.

Figure 9:
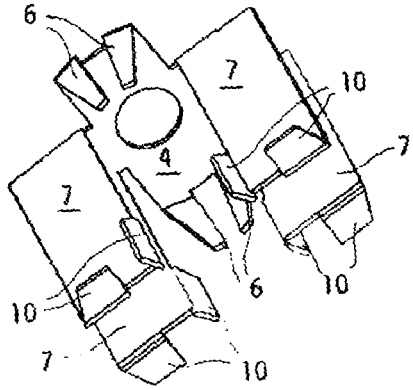
FIG. 9 illustrates in perspective view the metallic foil used according to FIG. 8, in its final shape.
Figure 10:
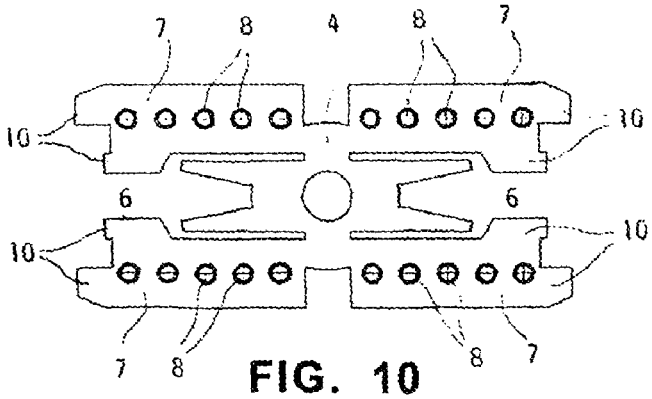
FIG. 10 illustrates in a plan view a semi-finished metallic foil from which, by bending operations, is obtained the metallic foil according to FIG. 9.

In those cases in, which not only the end face of rotor 1 has to be reinforced, but also the space 2 for the vanes, to the rotor may be fixed a metallic foil as that represented in FIG. 9. This metallic foil yet comprises a plane surface 4 intended to form the front surface of the rotor, from which extend root tongues 6 bent at right angle. Moreover, from the surface 4 also extend strips 7 bent at right angle, that are intended to form the inner surfaces of the space 2 for the vanes and, if the case may be, could be provided with holes 8. It is also of advantage that the strips 7 are terminated, at their end portions opposite the plane surface 4, by tongues 10 suitable for being bent against corresponding surfaces of rotor 1, in order to render the metallic foil perfectly solid to the rotor. The described metallic foil 4-7 is obtained, by several subsequent bending operations, from a plane semi-finished piece as that represented in FIG. 10, which has been sheared from a metallic plate.

The described metallic foils can be manufactured of any suitable metallic material, but especially of steel sheet or a suitable aluminum alloy sheet, although also other metals, such as brass and aluminum bronze, could be chosen. Their application to the rotor moulded of plastic material, either effected by co-moulding or, by mechanical application, allows attaining the advantages stated in the preamble. Of course, although the application to a rotor of only one metallic foil has been described, a rotor may receive the application of more than one reinforcement metallic foil, when needed.

It is to be understood that the invention is not limited to the embodiments described and illustrated as examples. Several possible changes have been stated in the description, and various others are within the capacity of a skilled person. The cited changes and others, and any replacement by technically equivalent means, may be introduced in what has been described and illustrated, without departing from the spirit of the invention and the scope of this Patent as defined by the appended Claims.

The invention claimed is:

1. A rotor, moulded of plastic material, capable of being rotatably mounted into a cavity of a pump body, and having a space extending through a center of the rotor for accommodating one or more vanes therethrough forming pumping members, wherein at least a part of the surfaces thereof, which undergo sliding displacements against a wall of the pumping cavity and the one or more vanes, is covered by at least one metallic foil adhered to the subjacent surface of the plastic material to reduce the resistances to the sliding displacements and to mechanically reinforce the rotor, wherein said metallic foil has a main substantially plane working surface with a diametral portion slightly projecting in correspondence with the space for the one of more vanes, and from which extend some portions bent with respect to the main substantially plane working surface and having a shape to fasten the metallic foil to the rotor, and wherein the metallic foil and the rotor are joined by one of mechanical fastening and means of a co-moulding operation.

2. A rotor according to claim 1, wherein said metallic foil consists of a steel sheet or an aluminum alloy sheet.

3. A rotor according to claim 1, wherein said metallic foil is integral to the rotor of plastic material by said co-moulding operation.

4. A rotor according to claim 1, wherein said metallic foil is mechanically attached to the rotor of plastic material.

5. A rotor according to claim 1, wherein said substantially plane working surface covers an end surface of the rotor.

6. A rotor according to claim 5, wherein said bent portions line the rotor space designed for receiving the vanes, and are terminated at their end portions opposite said main substantially plane surface by conformations.

7. A rotor according to claim 5, wherein said bent portions line the rotor space designed for receiving the vanes, and are terminated at their end portions opposite said main substantially plane surface by tongues being bent against corresponding rotor surfaces adjacent to said space accommodating said one or more vanes.

8. A rotor according to claim 1, wherein torque is transmitted directly to the plastic material of the rotor.

* * * * *